United States Patent [19]

Haines

[11] 4,044,588

[45] Aug. 30, 1977

[54] HIGH SPEED BALL HEADER

[75] Inventor: Allan D. Haines, Tiffin, Ohio

[73] Assignee: The National Machinery Co., Tiffin, Ohio

[21] Appl. No.: 699,892

[22] Filed: June 25, 1976

[51] Int. Cl.[2] ..... B21D 28/00

[52] U.S. Cl. ..... 72/337; 10/11 T; 10/76 T

[58] Field of Search ..... 72/337, 338, 294, 352, 72/360, 361, 432; 10/11 T, 12 T, 72 T, 76 T, 25, 11 R; 29/148.4 B

[56] References Cited

U.S. PATENT DOCUMENTS

| | | | |
|---|---|---|---|
| 911,911 | 2/1909 | Sisson | 72/360 X |
| 1,711,218 | 4/1929 | Abel | 10/11 T |
| 2,017,309 | 10/1935 | Friedman | 10/11 T X |
| 2,338,330 | 1/1944 | Huebner | 10/11 T |
| 2,800,814 | 7/1957 | Lewis | 72/360 X |
| 3,425,075 | 2/1969 | McMurray | 10/12 T X |
| 3,919,874 | 11/1975 | Harris | 72/337 |
| 3,972,216 | 8/1976 | Messerschmidt | 72/337 |

*Primary Examiner*—James R. Duzan
*Attorney, Agent, or Firm*—McNenny, Pearne, Gordon, Gail, Dickinson & Schiller

[57] ABSTRACT

A ball header is disclosed in which the movable die is mounted directly on the machine frame rather than on the reciprocating slide. The position of the movable die is controlled by a cam driven pusher so that the movable die position is dependent of the position of the reciprocating slide. The machine provides a greater portion of the machine cycle for the movement of the transfer from between the dies after the blank is gripped and controlled by dies. The machine further provides a closed or bushing cutter to improve the shearing of the blanks from the wire stock so that the part formed by the machine can be closer to the finished size of the product to reduce the material content and the cost of finishing operations. The accuracy of the positioning of the movable die is also improved by the mounting of the movable die directly on the frame rather than on the reciprocating slide.

22 Claims, 12 Drawing Figures

Fig. 1
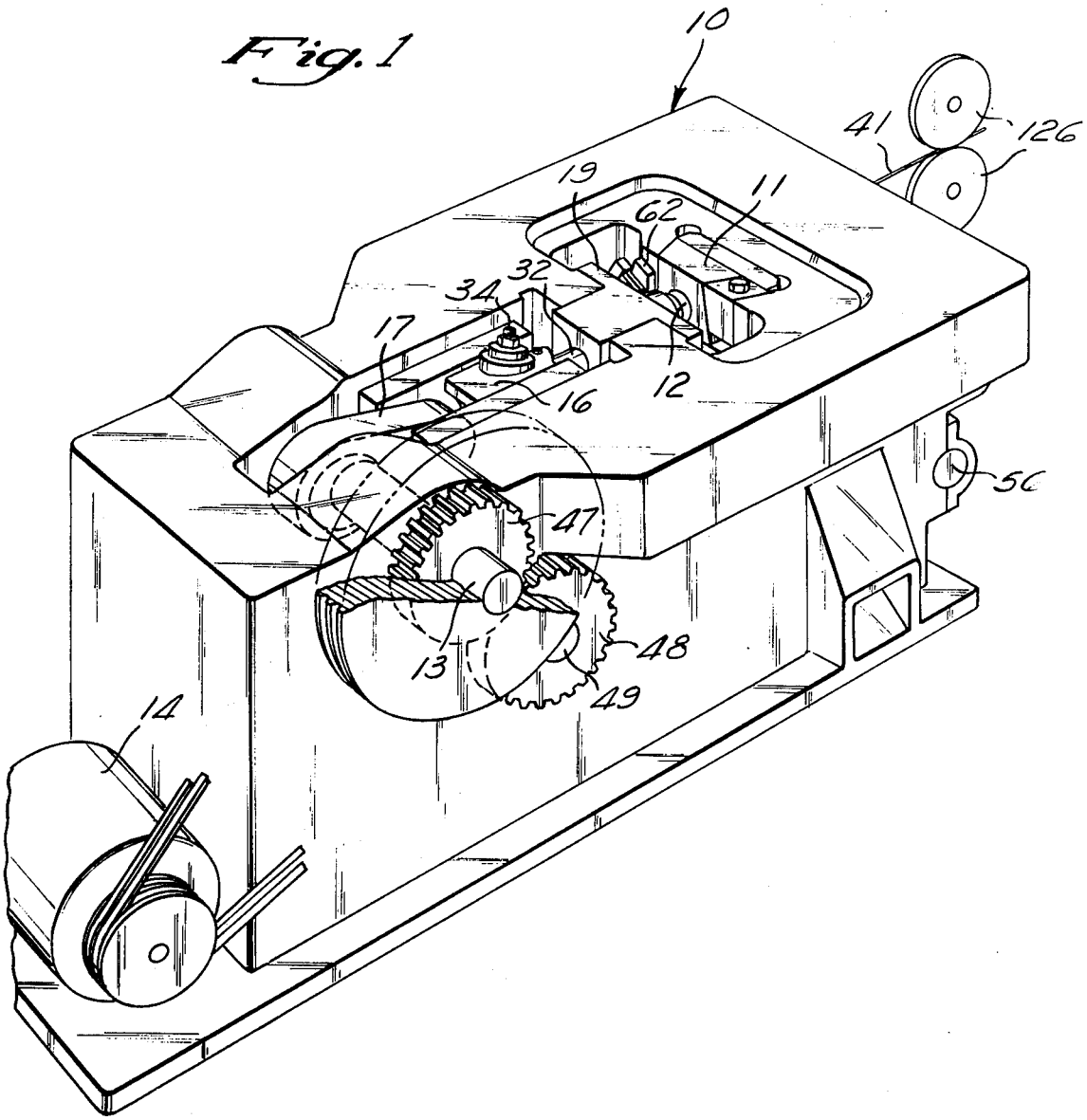
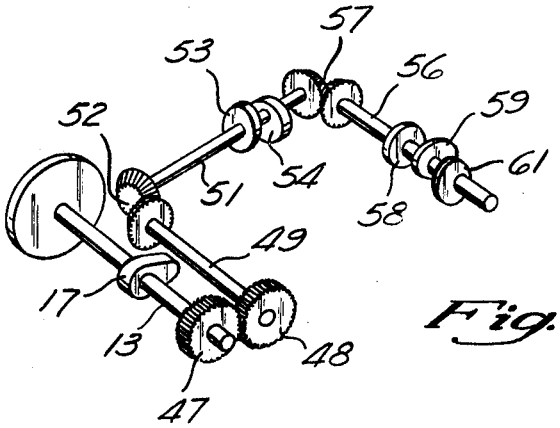
Fig. 1a

HIGH SPEED BALL HEADER

BACKGROUND OF THE INVENTION

This invention relates generally to headers or the like and more particularly to a novel and improved header particularly suited for forming parts such as balls, rollers, slugs, and the like.

PRIOR ART

Ball headers are often used to form a rough or intermediate ball from a cylindrical blank. Usually such intermediate ball is formed with a general ball shape and has centrally located flash along an equator extending radially around the ball. The intermediate or rough ball is usually tumbled to remove the flash, heat treated and ground to the final size and finish.

In at least some prior art ball headers, the movable die has been mounted on a reciprocating header slide for limited movement with respect to the slide in the direction of slide movement. In such machines a transfer positions the blank for gripping by the dies and the movable die is carried by the slide to a gripping position in which the blank is gripped between the dies to establish blank control before the transfer is retracted. The transfer is then retracted while the movable die remains stationary and the slide continues to move forward. The length of time available for the retraction of the transfer has been determined by the speed of the slide and the amount of movement permitted between the slide and movable die.

In practice the speed of the machine has been limited in such prior art machines to provide sufficient time to allow retraction of the transfer after the gripping control of the blank is established by the dies.

Such prior art machines have also generally utilized an open cutter which does not produce as accurate a cut as a closed or bushing cutter when shearing a blank from wire stock. Consequently, it has been necessary to operate the machine with substantial flash to ensure a complete filling of the ball. Also it has been necessary to form oversized intermediate balls to ensure that the ground and finished ball is provided with the proper shape and finish.

Savings are achieved in two ways if the size of the ball can be reduced or the amount of flash can be reduced without sacrificing the quality of the finished part. First the quantity of material required to produce a given finished ball is reduced so material savings result. Second the expense of removing flash and expense of grinding is reduced when the forged ball is closer to the finished size and the amount of flash is reduced.

SUMMARY OF THE INVENTION

There are a number of aspects to the present invention. In accordance with one important aspect of the present invention the movable die of the header is supported directly on the machine frame for limited movement in the direction of slide movement. The structure is arranged so that the position of the movable die is independent of the slide position except during the actual working portion of the machine cycle during which the slide engages the movable die and moves it toward the stationary die to work the blank.

During the remaining portions of the cycle the position of the movable die is controlled by separate control means independent of slide position. With such structure the blank can be gripped between the dies while the slide is spaced substantially back from its forward dead center position and a greater portion of the machine cycle is available for extension and retraction of the transfer. The timing of the transfer and ejection operations are therefore not dictated by the slide position.

In the illustrated embodiment the movable die is moved forward to its blank gripping position while the slide is in the region of its back dead center position and a greater portion of the machine cycle is available for the extension and retraction of the transfer. Similarly the rearward movement of the movable die closely follows the retraction of the slide and ejection is commenced early in the cycle. Consequently a machine in accordance with the present invention operates at higher cyclic speeds.

In the illustrated embodiment a movable die pusher is operated by a cam driven lever in timed relation to the machine operation. The cam is shaped to push the movable die back from the fixed or stationary die as the slide commences to move back from its forward dead center position. Consequently ejection of the finished part occurs soon after the forming operation is completed. The pusher then maintains the movable die in its retracted position as the slide continues to move toward its back dead center position and a blank is carried by the transfer into proper position between the dies. The pusher then retracts allowing the movable die to move back to its gripping position in which the ends of the blank are gripped between the two dies while the slide is in the region of its back dead center position. As soon as control of the blank is established by the gripping of the ends of the blank by the die, retraction of the transfer commences. In the illustrated embodiment the gripping occurs sufficiently ahead of forward dead center to provide a substantially larger portion of the machine cycle for the retraction of the transfer. Consequently higher cyclic rates are provided by a machine incorporating the present invention.

In accordance with another aspect of this invention the machine is provided with a bushing or closed cutter. Such cutter produces a cleaner cut when the blank is sheared from the wire stock. The ends of the blank formed by such shear are more nearly square and have fewer irregularities than the ends of blanks formed in an open shear. With a machine utilizing such a closed or bushing shear the amount of flash required to ensure the complete filling of the part is reduced and the part can be formed closer to the finished size without reducing the quality and finish of the completed ground part. Consequently with a machine incorporating the present invention, for example a ball header, savings are achieved because less stock is required to make a given part and savings in subsequent working operations such as flash removal and grinding are also realized.

In accordance with still another aspect of this invention the maximum spacing between the movable die and the stationary die is reduced and results in better confinement of the ejected part. This facilitates removal of the part from the working station.

In accordance with another aspect of this invention the support of the movable die on the machine frame provides improved accuracy of the positioning of the movable die since any clearance or wear of the bearings of the header slide does not adversely affect tool alignment. In prior art machines discussed above in which the movable die is supported from movement on the slide the accuracy of the positioning of the movable die is determined by two sets of bearings, namely the bearings supporting the slide on the frame and the bearings supporting the movable die on the slide. Any looseness in such bearings is additive and reduces the accuracy of the positioning of the movable die. In the present machine only a single bearing system is required to support the movable die in the machine frame and greater accuracy in the positioning of the movable die is achieved.

These and other aspects of the present invention are discussed in the following detailed description.

BRIEF DESCRIPTION OF THE DRAWINGS

FIG. 1 is a prospective view of a ball header incorporating the present invention;

FIG. 1*a* is a schematic illustration of the camshaft system of the machine;

DETAILED DESCRIPTION OF THE DRAWINGS

Figure 2:
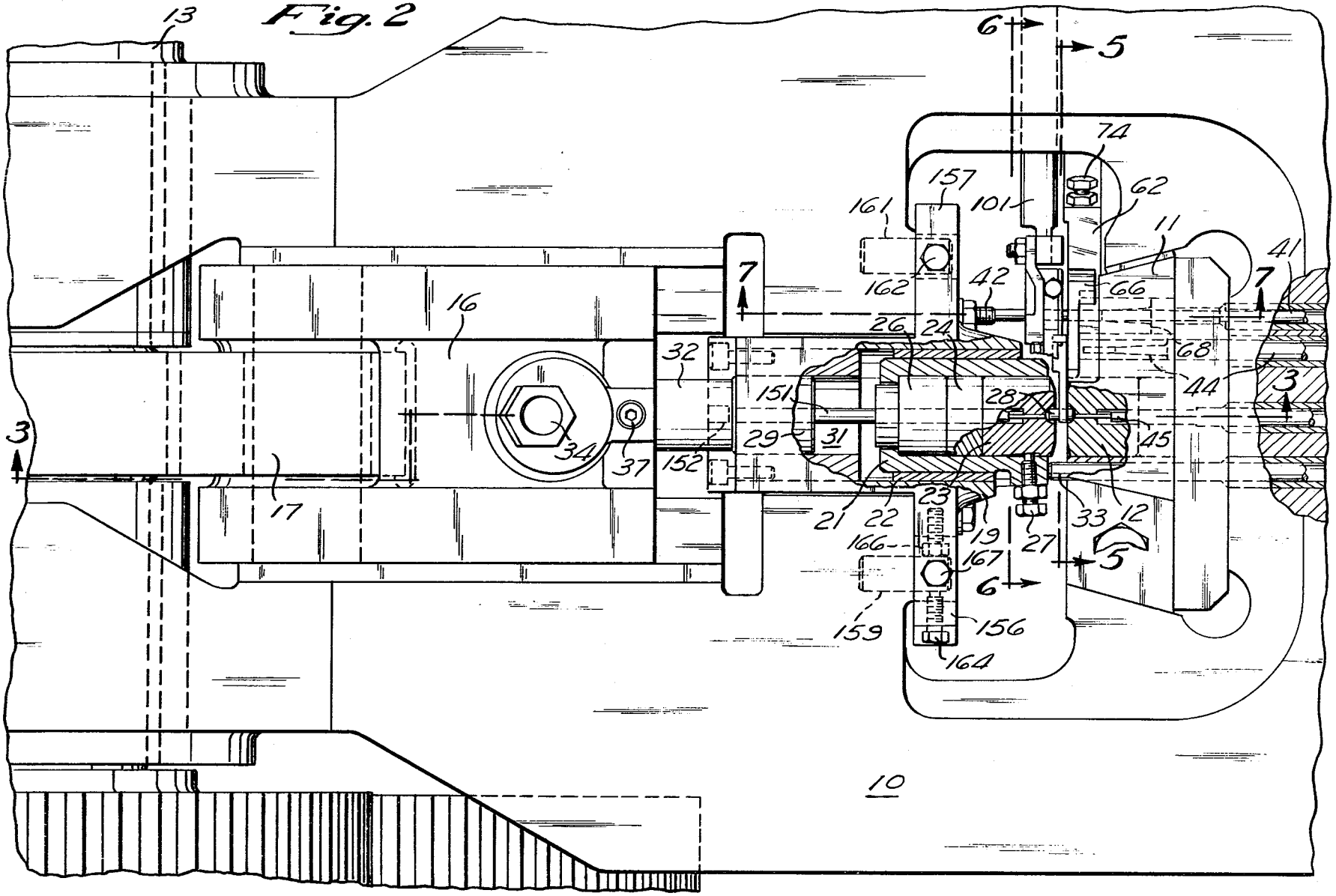
FIG. 2 is a plan view partially in section illustrating the structural arrangement of the machine.
Figure 3:
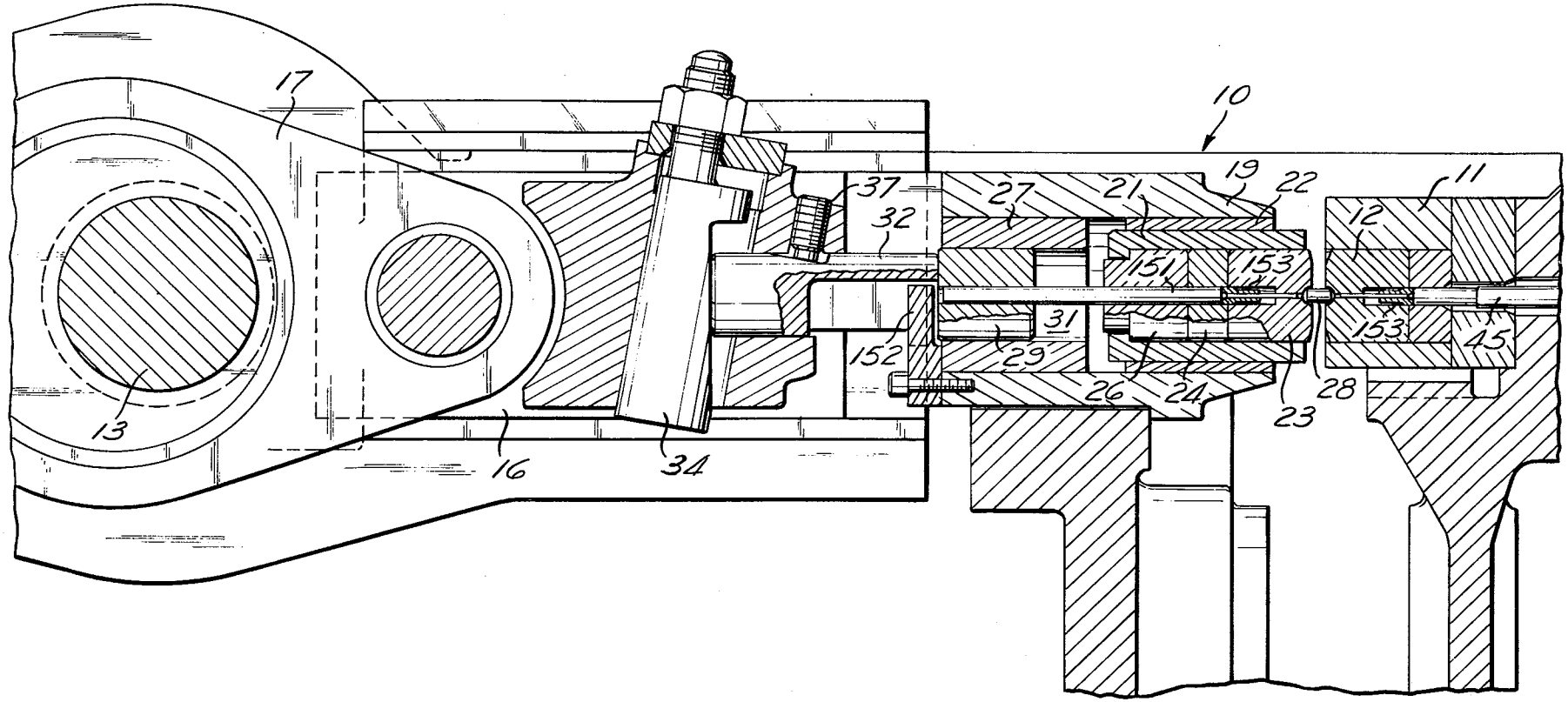
FIG. 3 is a slide elevation taken generally along 3—3 of FIG. 2.

Referring to FIGS. 1 through 3 the machine includes a frame 10 which supports a removable die breast 11 in which a stationary die 12 is mounted. Journaled on the frame 10 is a crankshaft 13 powered by a motor 14. A reciprocating slide 16 is supported in the frame for a reciprocating movement toward and away from the die breast 11 and is connected to the crankshaft 13 by a pitman 17 in the usual manner so that the slide moves back and forth through one complete cycle during each 360° of rotation of the crankshaft.

A movable tool or die holder 21 is supported on the frame for movement in the same direction as the slide 16. The structure for supporting the movable tool is best illustrated in FIGS. 2 and 3 and includes a stationary die support 19 removably mounted on the frame 10 of the machine. Movable die holder 21 is slidably supported in a cylindrical bearing 22 within the die support 19 for limited movement in the frame 10 toward and away from the die breast 11. The movable die 23 is positioned forward of two spacer blocks 24 and 26. A lock screw 27 locks the movable die and blocks in the movable die holder 21.

The die holder 21 is free to move from a blank gripping position illustrated in FIGS. 2 and 3 forward to an extended position adjacent to the stationary die 12 and a cylindrical blank 28 is formed from the cylindrical shape to the required rough or intermediate ball shape during such movement. The die holder 21 also allows rearward or retraction movement from the gripping position illustrated to separate the two dies 12 and 23 sufficient to allow ejection of a workpiece and the transfer of a subsequent blank into position for working.

Mounted within a bearing sleeve 27 at a location spaced back from the die holder 21 is a sliding member 29 which cooperates with the die holder to define a chamber 31 which is supplied through an inlet (not illustrated) with compressed air. The compressed air functions to resiliently bias the die holder 21 forward in the direction toward the stationary die 12 and biases the sliding member 29 rearwardly into engagement with a drive member 32 carried by the slide 16. Therefore the die holder 21 is continuously urged toward the stationary die into engagement with a die pusher 33 which is described in greater detail below. A wedge 34 is provided to adjustably position the drive member 32 with respect to the slide 16 and is provided with a nut for adjustably positioning and locking the wedge. In the event that the machine is stalled in the forward dead center position release of the wedge permits the freeing of the machine. A screw 37 operates to lock the drive member against the face of the wedge when the wedge is properly adjusted.

Since the sliding member 29 is maintained against the forward end of the drive member 32 by the pressure within the chamber 31 it reciprocates back and forth with the slide 16. The slide 16 and in turn the sliding member 29 are illustrated in FIGS. 2 and 3 at the back dead center position and the sliding member 29 is substantially spaced from the rearward face of the spacer block 26. As the slide 16 is carried forward toward the forward dead center position the sliding member 29 moves into engagement with the spacer block 26 and thereafter moves the movable die 23 toward the stationary die 12 to perform a working operation on the blank 28. Subsequently as the slide 16 commences to move back toward its back dead center position the slider member 29 moves back from the spacer block 26 and the movable die does not move back from the stationary die with the slide. Instead the die pusher 33 illustrated in FIG. 2 functions to separate the two dies in the manner discussed below.

With this structure the position of the movable die 23 is independent of the position of the slide 16 excepting during the actual working portion of the stroke when the movable die is moved forward by the slide to upset the blank 28 to the required shape. Therefore the movement of the die 23 can and is controlled to provide the optimum timing of the other machine operations and the speed of the machine can be increased.

Referring to FIG. 2 wire stock 41 is fed into the machine from the right side as viewed in FIG. 2 to a stock gauge 42. A cutter 66 operates to shear the blanks 28 from the stock 41 and carried the blank to a transfer station in alignment with a transfer pin 44. The transfer pin 44 operates to eject blank from the cutter 66 into transfer fingers 46 which in turn carry the blank 28 to the working position between the dies 12 and 23 while the dies are separated by the pusher 33. The operation of the machine is timed so that the pusher 33 retracts allowing the air within the chamber 31 to move the die holder 21 to the illustrated position in which the ends of the blank are gripped between the two dies to maintain control of the blank when the transfer fingers 46 are retracted clear of the dies. Subsequently the slide 16 operates to drive the movable die 23 forward as the slide moves to its forward dead center position to work the blank to the required generally spherical shape.

Referring to FIG. 1*a* a group of cams operate the various mechanisms of the machine and the cams are driven in timed relationship to the slide movement by a camshaft arrangement schematically illustrated in FIG. 1*a*. The crankshaft 13 is provided with a gear 47 mounted on one end which meshes with a driven gear 48 sized to provide a one to one speed ratio. The gear 48 is mounted on a cross shaft 49 which drives a longitudinally extending shaft 51 through a pair of miter gears 52.

Two cams 53 and 54 are mounted on the longitudinally extending shaft 51. The first cam 53 is utilized to operate the transfer and the second cam 54 operates the cutter arm 62. A second laterally extending shaft 56 is driven from the shaft 51 through a second pair of miter gears 57 and is provided with three cams 58, 59 and 61. The cam 58 operates the transfer pin 44 to eject the blank from the cutter into the transfer, the cam 59 operates the ejector 45 and the cam 61 operates the die pusher 33. The structure of the various cam driven mechanisms is discussed in greater detail below. Since all of the various cams are driven at the same speed as the crankshaft each cam rotates through 360° during a given machine cycle, and the timing of the various operating mechanisms controlled by the cams are automatically timed with the operation of the slide and with the operation of the other mechanisms.

Figure 5:
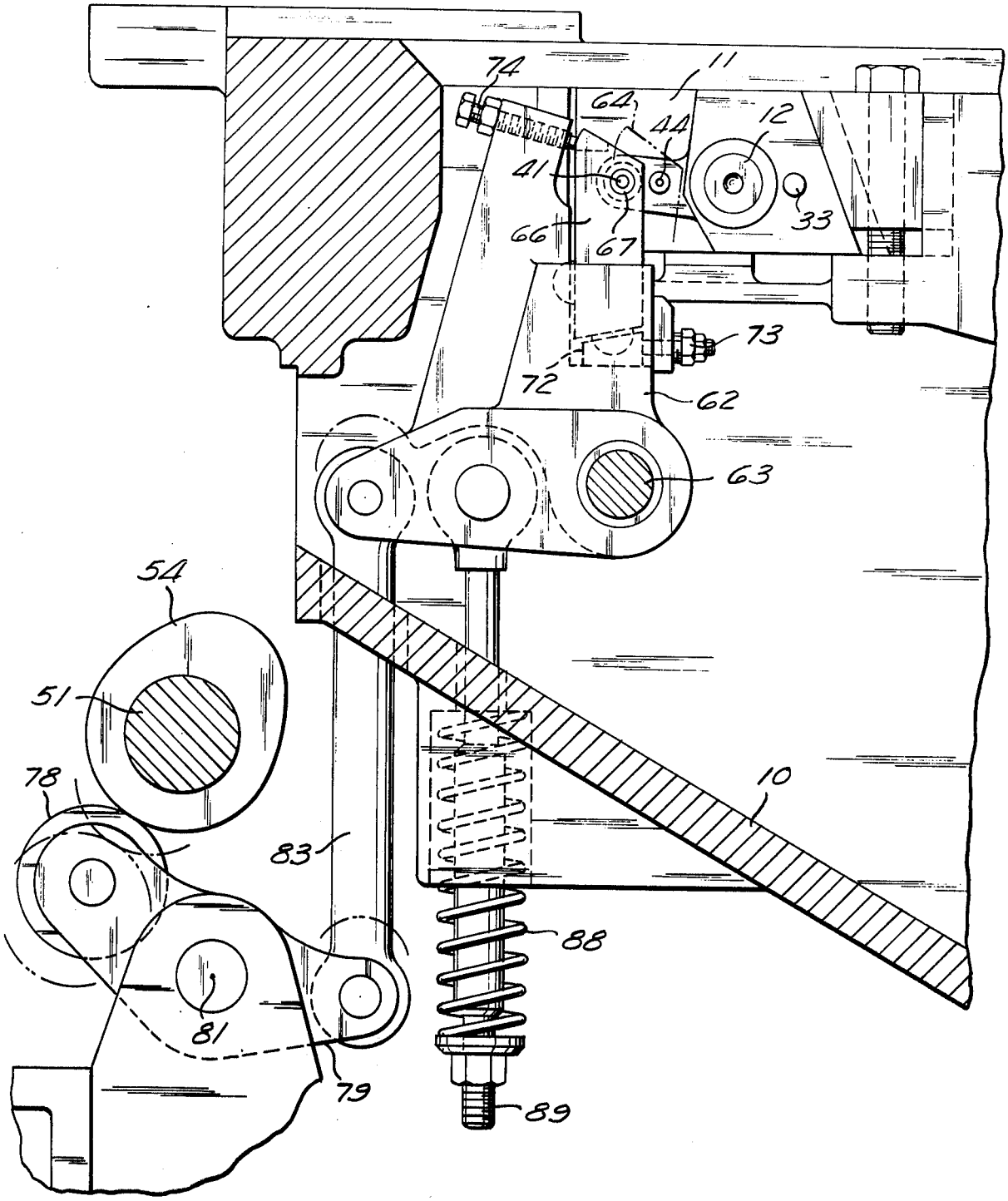
FIG. 5 is a fragmentary cross section taken generally along 5—5 of FIG. 2 illustrating the face of the stationary die and the cutter mechanism.
Figure 7:
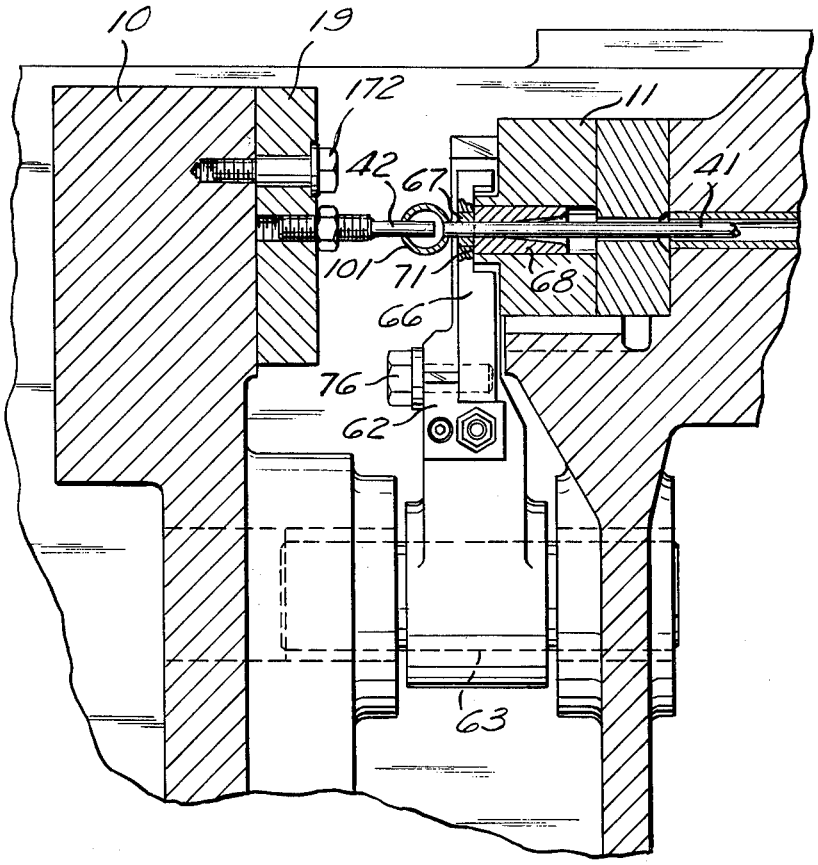
FIG. 7 is a fragmentary cross section taken generally along 7—7 of FIG. 2 illustrating the structure of the stock gauge and its adjustment mechanism.

Referring to FIGS. 5 and 7 the cutter arm 62 is supported on a pivot shaft 63 for oscillating rotation between the position illustrated in FIG. 5 and an operated position illustrated in phantom at 64. Carried by the cutter arm 62 is a cutter blade 66 provided with a hardened cutter ring 67 through which the wire stock 41 is fed while the cutter is in the position of FIG. 5. A hardened cutter ring 68, fixed against movement with respect to the machine frame 10, constitutes the other part of the shear. While the cutter is in the position of FIG. 5 the feed rolls operate to push the wire stock 41 forward through the two cutter rings 67 and 68 until the forward end of the stock engages the stock gauge pin 42. The position of the stock gauge pin is adjustable. The cutting or shearing plane 71 is located centrally with respect to the cutter arm 62 and in turn centrally with respect to the bearing supporting the pivot shaft 63 as best illustrated in FIG. 7. Therefore the cutting loads do not produce twisting or material bending of the structure.

After the stock has been fed forward into engagement with the stock gauge pin, the cutter arm 62 is rotated in a clockwise direction as illustrated in FIG. 5 causing a blank 28 to be sheared from the forward end of the stock 41 and causing the blank to be carried within the ring 67 into alignment with the transfer pin 44. With the illustrated structure in which a solid cutter ring or bushing is provided, a cleaner and more accurate cut is made so greater blank uniformity is achieved and the ends of the blank are provided with better squareness than is obtainable when using an open cutter or the like.

The cutter blade is adjustably mounted on the cutter arm by means of a wedge 72 which is adjustably positioned by a screw 73 for vertical position adjustment. Lateral position adjustment is provided by a screw 74. With this arrangement adjustment of the position of the cutter ring 67 can be provided. A lock screw 76 secures the cutter to the cutter arm as illustrated in FIG. 7. Such screw has not been illustrated in FIG. 5 in order to simplify the drawing.

The oscillating movement of the cutter arm 62 is produced by a cam driven linkage best illustrated in FIG. 5. The cam 54 mounted on the shaft 51 is engaged by a cam follower 78 and is mounted on a rocker arm 79 pivoted for rotation about an axis 81. Mounted on the other end of the arm 79 is a link 83 which moves up and down as the rocker arm 79 is pivoted by the cam 54. Top end of link 83 is connected to the arm 62.

A spring 88 applies a downward force to a pull rod 89 which is in turn connected to the cutter arm 62 to bias it in an anti-clockwise direction as viewed in FIG. 5 to maintain the linkage loaded against the action of the cam 54. The spring 88 functions to return the cutter arm to the illustrated position after a cutting operation but a positive mechanical drive is provided by the cam 54 to supply the shearing force necessary for the cutter operation.

Figure 6:
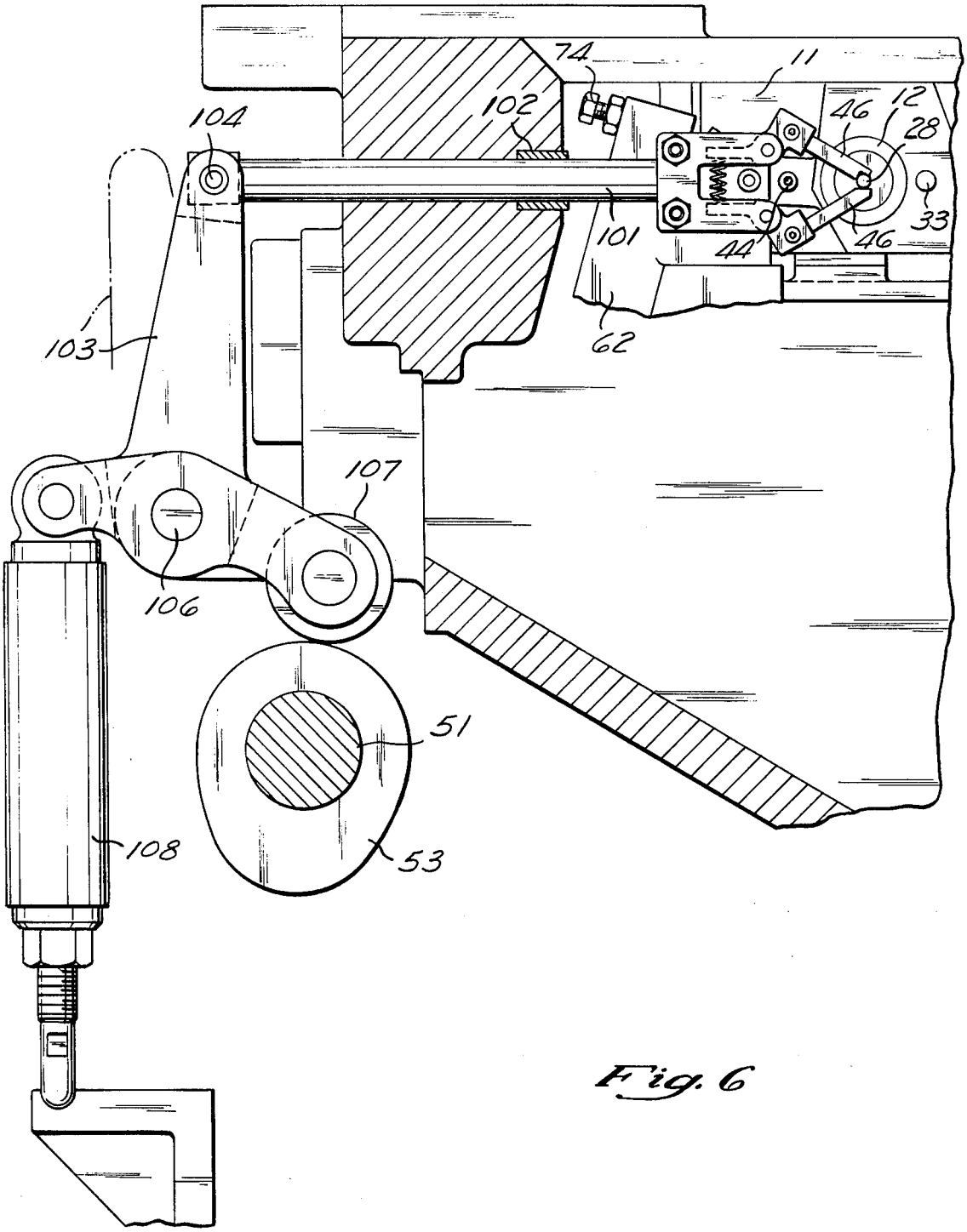
FIG. 6 is a cross section taken generally on along 6—6 of FIG. 2 illustrating the structure and drive for the transfer.

The transfer mechanism is best illustrated in FIG. 6. This mechanism includes a transfer arm 101 slidably mounted bearing 102 and connected to a rocker arm 103 by a pivot pin 104. The rocker arm 103 is pivotably supported on a pivot pin 106 on the machine frame and is provided with a cam follower 107 which engages the cam 53 on the shaft 51. A spring assembly 108 is also connected to the rocker arm to bias the arm in a clockwise direction as illustrated in FIG. 6. In this instance the spring force is utilized to move the transfer forward to the die position illustrated in FIG. 6 and the cam 53 operates to move the transfer back positively to the position in which it receives a blank from the cutter. Mounted on the forward end of the transfer arm 101 are the transfer fingers 46 which are spring biased toward the gripping position.

The transfer is timed with the operation of the machine so that it moves back to position the fingers 46 for gripping a blank carried by the cutter when the cutter is in position in alignment with the transfer pin 44. While the transfer and cutter remain in such positions the transfer pin 44 operates to push the blank out of the cutter so that the blank is supported only by the transfer fingers 46 for subsequent movement during the next extension of the transfer to position the blank between the two dies 12 and 23 as illustrated in FIG. 2. After the blank is gripped by the two dies as discussed above the transfer is withdrawn so that the fingers are clear of the dies prior to the working operation.

Figure 8:
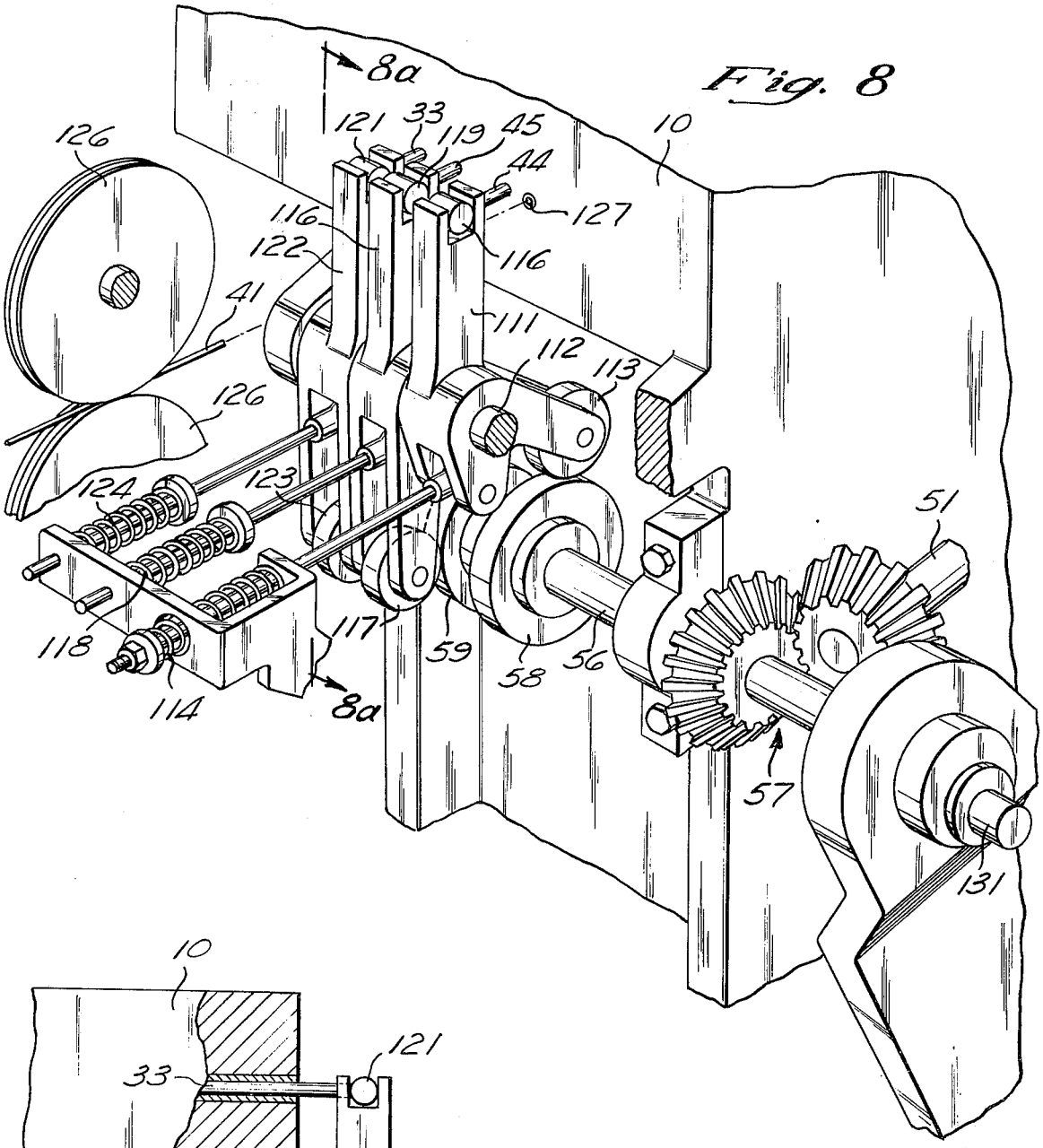
FIG. 8 is a fragmentary prospective view illustrating the wire feed and the cam system for operating the movable die pusher and the two ejectors.
Figure 8A:
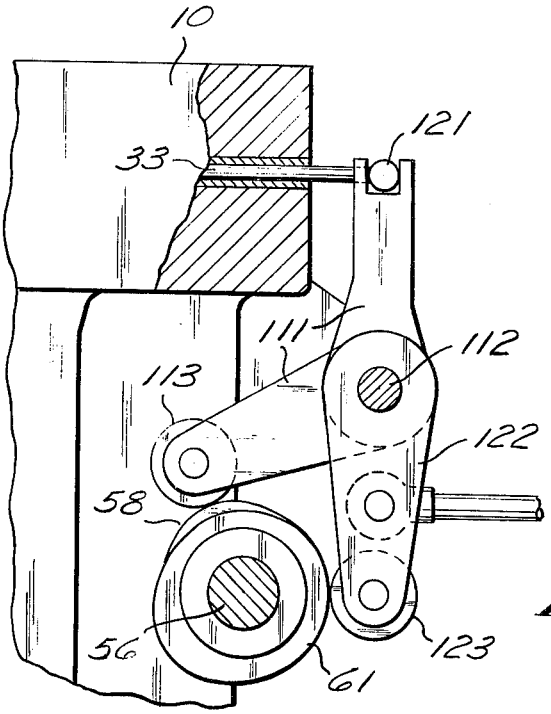
FIG. 8*a* is a fragmentary side elevation taken generally along 8*a*—8*a* of FIG. 8.

Referring to FIG. 8 and 8*a* the transfer pin 44 is operated by a rocker arm 111 journaled on a support shaft 112. A follower 113 on the arm 111 engages the cam 58 causing oscillating rotation of the rocker arm 111 in response to the rotation of the cam 58. A tension spring assembly 114 is connected to the rocker arm to bias the arm 111 in a clockwise direction as illustrated in FIG. 8 and maintains the roller 113 in engagement with the associated cam 58. The upper end of the arm 111 provides a yoke which encloses a cylindrical connector 116 threaded onto the rearward end of the pin 44. Consequently when the cam 58 allows the spring to rotate the arm 111 in a clockwise direction the pin 44 is moved forward by the spring and operates to push a blank from the cutter so that it is supported by the transfer fingers as discussed above. Preferably the pin 44 is threaded into the connector 116 so that the position of the pin can be easily adjusted.

Substantially similar structures are provided for controlling the operation of the die pusher 33 and ejector pin 45. The ejector pin 45 is connected to the upper end of a rocker arm 116 which is also pivoted on the shaft 112 and is provided with a cam follower 117. In this instance, however, the rocker arm 116 is arranged so that it is positively driven clockwise as the ejector pin 45 ejects ball from die and is spring returned. Consequently a compression spring assembly 118 is connected to bias the rocker arm 116 in an anti-clockwise direction to maintain contact between the roller 117 and its associated cam 59. Here again the upper end of the rocker arm 116 is provided with a yoke to receive a cylindrical drive connector 119 connected to the rearward end of the pin 45.

The pusher 33 is provided with a drive connector 121 connecting the pusher to the upper end of a rocker arm 122 which is also pivoted on the shaft 112. Here again a follower 123 is mounted on the rocker arm 122 for engagement with its associate cam 61 illustrated in FIG. 8*a.* A compression spring assembly 124 biases the rocker arm 122 in an anti-clockwise direction as viewed in FIG. 8 so the pusher 33 like the ejector pin 45 is positively driven in the forward direction and is retracted by its associated spring assembly.

Figure 9:
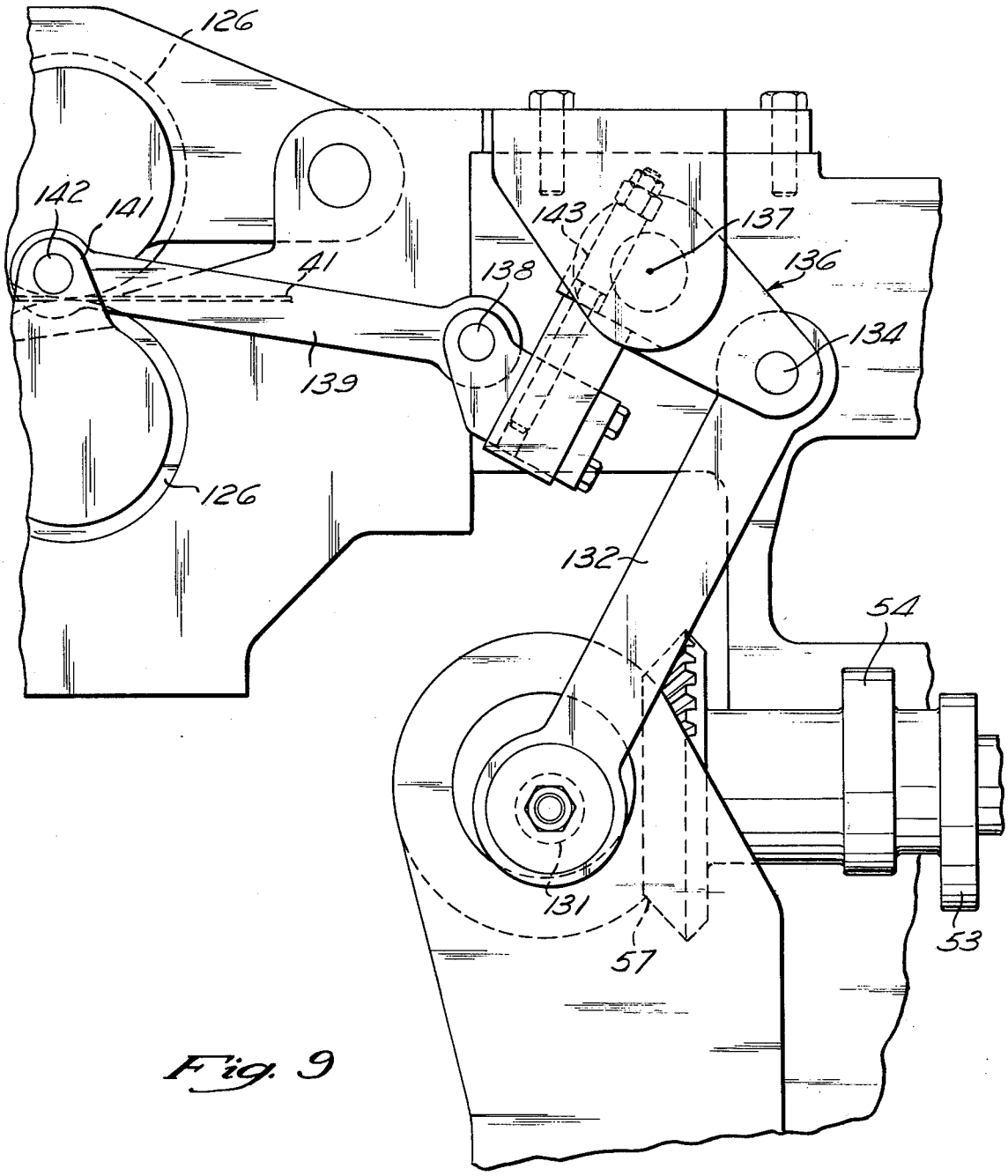
FIG. 9 is a fragmentary side elevation of the mechanism for driving the stock feed rolls; and, FIG. 10 is a timing diagram of the machine illustrating the relationships of the timing of the various operations.

A pair of feed rolls 126 engage the wire stock 41 and operate to feed the stock forwardly into the machine through the stock opening 127 in response to a drive system best illustrated in FIG. 9. This mechanism includes an eccentric crank 131 provided on the end of the shaft 56 which drives a drive link 132. The drive link 132 is connected to a rocker arm assembly 136 at pin 134. Such assembly is pivoted on the machine frame at 137 and is oscillated back and forth around its pivot.

Link 139 is connected to the input arm 141 of the feed rolls by pivot 142 and to rocker arm assembly 136 at pin 138. When the rocker arm assembly 136 is rotated in an anti-clockwise direction as viewed in FIG. 9, the feed rolls are driven in the direction causing the wire stock to be fed into the machine in the usual manner. A one-way clutch and brake mechanism prevents backward feed of the rolls when the rocker arm assembly 136 moves in the clockwise direction during the remaining phase of the cycle.

Preferably the rocker arm assembly 136 is provided with an adjustment system 143 which permits the adjustment of the feed stroke while the machine is operating and a lock system which permits the feed to be disengaged or engaged while the machine is operating.

Referring to FIG. 3 a second ejector 151 is provided to ensure ejection of the finished part from the movable die 23. This ejector is operated by the rearward movement of the movable die 23 which causes the rearward end of the ejector pin 151 to engage a stationary stop 152. With this structure it is not necessary to provide separate power drive for the ejector 151 and it operates in response to the movement of the movable die. Springs (not illustrated) extend between each die 12 and 23 and the associated guides 153 to retract the guides and ejector pin 151.

Figure 4:
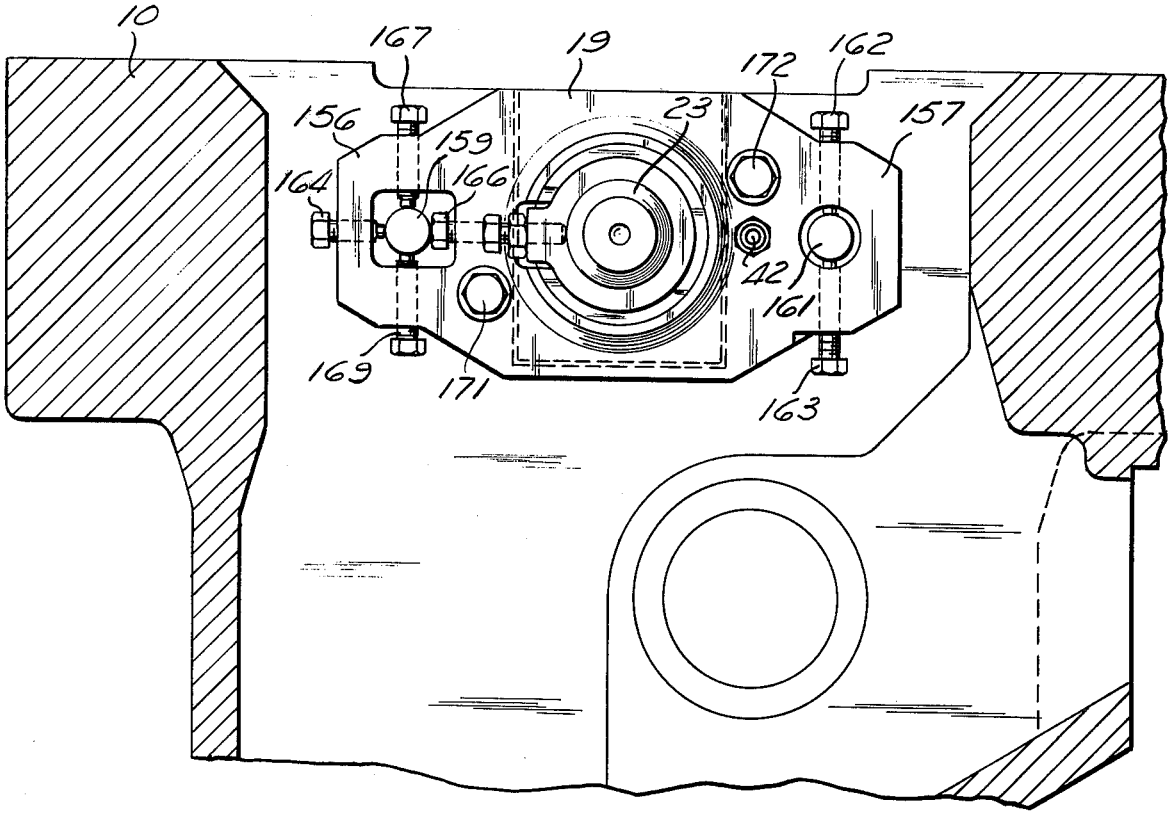
FIG. 4 is a cross section taken generally along the face of the movable die illustrating the structure for positioning such die.

FIGS. 2 and 4 illustrate the structure for adjustably positioning the movable die assembly with respect to the frame. In such structure the die support 19 is provided with lateral extension 156 and 157 which project along the forward surface of frame 10. A pair of pins 159 and 161 project through openings in the extensions 156 and 157 respectively. A pair of opposed screws 162 and 163 extend vertically in the projection 157 and operate to engage opposite sides of the locating pin 161. By adjusting the two screws 162 and 163 the right side of the die holder 19 (as viewed in FIG. 4) can be adjusted up and down and locked in any desired adjusted position.

Located in the extension 156 is an adjusting mechanism including a first pair of screws 164 and 166 which engage laterally opposite sides of the pin 159 and provides for lateral adjustment and positioning of the die holder 19. Vertical adjustment of the left side of the die holder as viewed in FIG. 4 is provided by a pair of screws 167 and 169. The two screws 167 and 169 are adjusted to adjust to the vertical position of the left side of the die holder 19 and for locking the left side in its adjusted position. With this simple structure the position of the tool holder and in turn the movable die can be accurately adjusted within the machine. After adjustment lock bolts 171 and 172 are tightened to maintain the die in its locked position.

Figure 10:
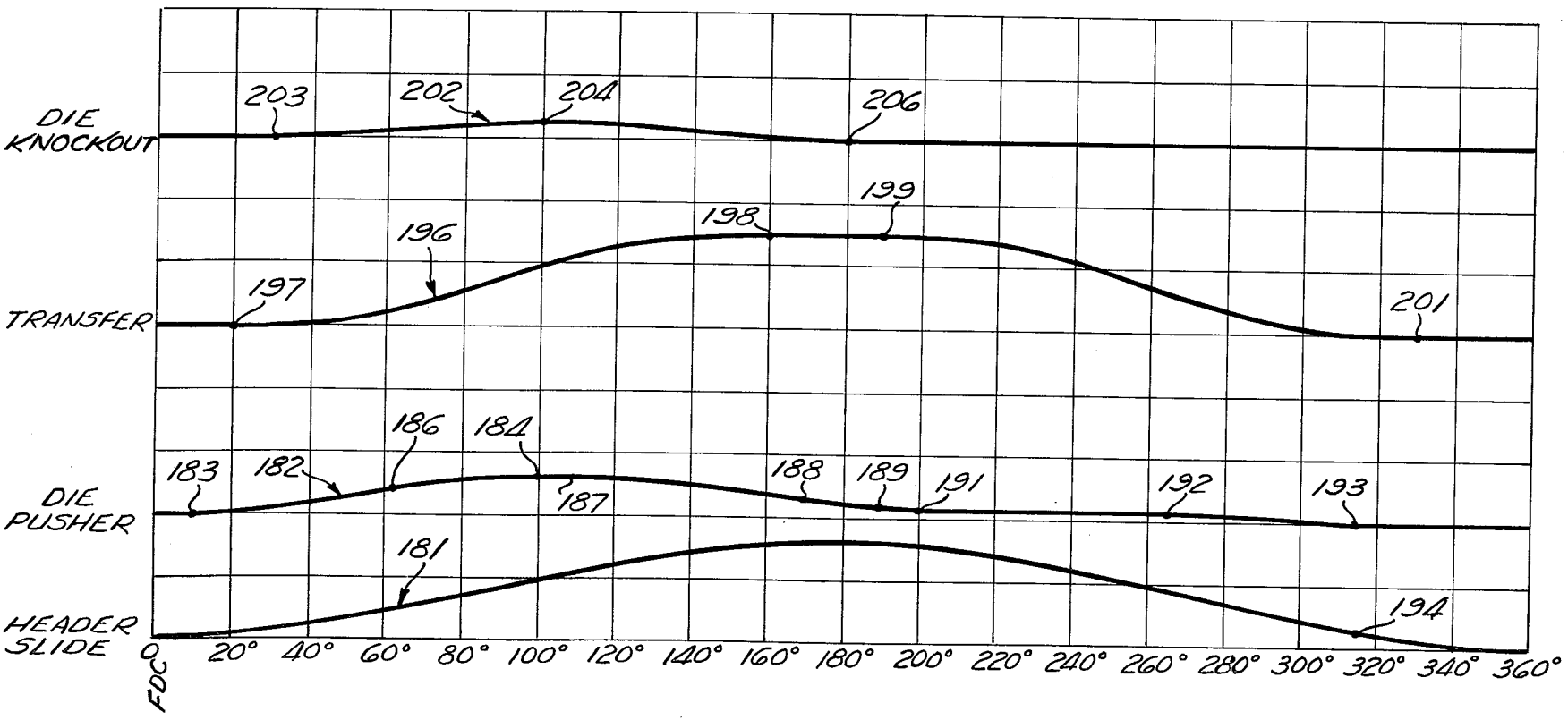

The preferred timing of the machine is best illustrated in FIG. 10 which is a timing diagram for the machine. In this diagram the crankshaft rotation is indicated in the horizontal direction and the movement of the various components or sub-assemblies of the machine are indicated in the vertical direction. In this diagram the actual displacements are not necessarily illustrated to scale.

The lower curve 181 is the curve of the header slide stroke and is substantially harmonic movement through a full cycle in 360° of crankshaft rotation. The crankshaft rotation is illustrated in the horizontal direction starting at the forward dead center position at 0° of crankshaft rotation and is in the back dead center position at 180° of crankshaft rotation.

The movement of the movable die holder 21 is represented by curve 182. The movable die commences to move back from its forward position after about 10° of crankshaft rotation as illustrated at 183 and reaches its fully retracted position at 184 after about 100° of rotation of the crankshaft. The various elements are proportioned so that the movable die knockout 151 engages the fixed stop 152 and commences ejection from the movable die at about 62° at the point 186 along the curve 182. At about 110° of crankshaft rotation at the point 187 the movable die holder 21 commences to move back toward the stationary die 12 and reaches the blank gripping position of FIG. 2 at a location between 170° and 190° in the zone between 188 and 189. The exact location of the gripping within the cycle depends upon the size of the ball and in turn the size of the blank being manufactured in the machine. However, since the gripping of the blank occurs early in the cycle while the header slide is substantially at its back dead center position, it is not necessary to modify the cam when the machine is used to manufacture different sized balls.

The cam 61 which controls the operation of the die pusher 33 is preferably shaped to cause the movable die to dwell at the 200° position illustrated 191 in the event that a blank is not properly positioned for gripping between the dies. If such dwell were not provided and if a blank were not gripped between the dies to prevent continued inward movement of the movable die the die could engage the transfer fingers before they were retracted. However, the provision of the dwell at 191 prevents the movable die from engaging the transfer fingers even when a blank is not positioned between the dies to prevent such engagement. The movable die dwell ends at about 265° at 192 so the die pusher 33 moves clear of the die to allow the forming operation to occur when the slide engages the movable die. The header slide engages the movable die at about the 315° location illustrated at 193 on the curve 182 and at 194 on the header slide curve 181. The working of the blank occurs between this point and the forward dead center position at 360° which is only about 45° of the crankshaft rotation.

The transfer movement is illustrated by the curve 196. The transfer commences to move toward the die from the position in which it receives the blank from the cutter at about the 20° location at 197. The transfer reaches the center line of the die at the 160° position at 198. Therefore about 140° of crankshaft rotation is allowed for the extension of the transfer.

It should be noted that the dies commence to close at the 110° position before the transfer reaches the center line. However, sufficient clearance is provided to allow the completion of the transfer operation before the die is closed sufficiently to interfere with the transfer operation.

The transfer dwells at the center line of the dies to the 190° position by which time the blank is gripped between the dies to allow the retraction of the transfer without losing control of the blank. The retraction of the transfer continues from the point 199 at about the 190° position to the 330° position at 201. Here, again, a substantial period of time is available for retraction of the transfer period. In the illustrated embodiment such retraction occurs through 140° of crankshaft rotation. The transfer then dwells while the blank is pushed out of the cutter at the blank receiving position.

The operation of the ejector or kick-out 45 is illustrated by the curve 202. The kick-out is commenced at 30° at 203 and continues to the 100° position at 204. Consequently the ball is ejected before the subsequent blank is carried by the transfer into the working position. Preferably a jet of compressed air is directed against the ball to facilitate its movement from the die area. The kick-out returns to its retracted position by the 180° position at 206, so it does not interfere with the gripping of the blank or the subsequent working thereof.

With the preferred embodiment of this invention 140° of crankshaft rotation is available for the extension of the transfer and again for the retraction of the transfer. Consequently, the portion of the cycle available for transfer operation is increased and higher machine speeds can be achieved. This increased period of the cycle available for transfer operation results from the fact that the gripping of the blank and the commencement of transfer retraction occurs while the header slide is substantially spaced from its forward dead center position. As mentioned above the gripping of the blank occurs in the illustrated machine while the header slide is substantially at its rearward dead center position.

Further, because the position of the die is independent of slide position, except during the actual blank working, the movable die need not move as far from the stationary die and can commence to retract away from the stationary die shortly after the slide reaches its forward dead center position. Since the position of the movable die dictates the timing of the transfer the combination of the present invention allows the optimization of all of the various machine functions which must be provided. Consequently, a closed cutter is practical and stock savings and savings in the subsequent finishing operations are achieved.

Further, the arrangement of the movable die in which it is supported in a single bearing on the machine frame contributes to the accuracy of the location of the movable die. Since the looseness or tolerances provided in the header slide do not adversely affect the positioning of the movable die, these bearings need not be manufactured to such close tolerances and can be used without detrimental effect even after substantial wear has occurred. This also contributes to the economy of the manufacture of the machine and economy of the maintenance of the machine.

Although a preferred embodiment of this invention is illustrated, it is to be understood that various modifications and rearrangements may be resorted to without departing from the scope of the invention disclosed and claimed.

What is claimed is:

1. A header comprising a frame, a stationary die mounted on said frame, a movable die mounted on said frame for movement relative to said stationary die between an extended position adjacent to such stationary die and a retracted position spaced from stationary die, a powered slide operable to a forward position to move said movable die to said extended position causing a blank to be formed by said dies, a transfer operable to position a blank for gripping by said dies, and control means operable independent of slide movement to cause movement of said movable die to a position in which said dies grip a blank held by said transfer.

2. A header as set forth in claim 1 wherein said slide is substantially spaced from the positions in which said slide causes forming of said blank when said dies grip a blank, and said transfer retracts from a position between said dies as said slide moves toward said forward position.

3. A header as set forth in claim 2 wherein said machine includes drive means for powering said slide and control means in timed relation.

4. A header as set forth in claim 3 wherein said drive means powers said slide for reciprocating movement between a back position and said forward position, and said slide causes forming of said blanks by said dies as it approaches said forward position, said slide being substantially at its rearward position as said dies grip said blank.

5. A header as set forth in claim 4 wherein said drive means includes a cam mechanism operating said control means.

6. A header as set forth in claim 5 wherein said control means includes spring means operable to urge said movable die toward said extended position and a cam driven pusher operable to overcome said spring means to move said movable die toward said retracted position.

7. A header as set forth in claim 6 wherein said pusher operates to retract said movable die from said extended position as said slide commences to move back from its forward position.

8. A header as set forth in claim 1 wherein said control means operates to retract said movable die from said extended position as said slide commences to move back from its forward position.

9. A header as set forth in claim 1 wherein said control means prevents engagement of said dies with said transfer when a blank is not positioned between said dies by said transfer.

10. A header as set forth in claim 1 wherein said machine includes a closed cutter operable to shear blanks from elongated stock and to deliver said blanks to said transfer at a transfer position.

11. A header comprised in a frame, a stationary die mounted on said frame, a movable die mounted on said frame for movement through a first distance toward and away from said stationary die between an extended position and a retracted position, a powered slide movable in said frame through a second distance substantially greater than said first distance between forward and rearward positions, said slide causing said movable die to move to said extended position for forming a workpiece during the last portion of slide movement to said forward position, and control means operable to position said movable die with respect to said stationary die independent of slide movement during the portions of said slide movement other than said last portion, and a transfer timed with the operation of said control means operable to position a blank between said dies for gripping by said dies while said slide is substantially spaced from said last portion of slide movement.

12. A header as set forth in claim 11 wherein said dies grip a blank while said slide is substantially at said rearward position.

13. A header as set forth in calim 11 wherein said first distance is not substantially greater than the distance required for positioning a blank between said dies and for removal of workpiece from said dies.

14. A header as set forth in claim 11 wherein ejector means are provided to eject workpieces from said movable die, said ejector means operating in response to movement of said movable die to said retracted position.

15. A ball header comprising a frame, a stationary die on said frame, a movable die on said frame operable in cooperation with said stationary die to form a cylindrical blank to a forged spherical shape with flash around its equator, a cutter including a closed stationary shear ring and a closed movable shear ring positioned in alignment to allow the elongated stock to feed through both rings, said movable shear ring being movable along the face of said stationary shear ring to shear said blanks from said stock with substantially square and smooth ends, an adjustable stock gauge operable to engage stock extending to said rings to determine the volume of stock in said blanks, and transfer means operable to receive blanks from said movable shear ring and to transfer said blanks to said dies, said cutter operating to produce a sufficiently smooth and square cut and said stock gauge being adjusted so that said machine produces forged balls having a diameter closely approaching size of the finished ball and a minimum flash without sacrificing finished ball quality.

16. A ball header as set forth in claim 15 wherein said movable cutter ring is supported on a cutter arm journaled for oscillating rotation around an axis parallel to the axes of said cutter rings, said cutter arm being journaled on spaced bearings symmetrically located on opposite sides of the plane of the adjacent ends of said shear rings whereby the shearing forces do not produce material twisting of the movable shear ring.

17. A header comprising a frame, a slide reciprocable in said frame, a stationary die supported on said frame, a movable die supported on said frame for movement in the direction of slide movement from a forward position adjacent to said fixed die in a retracted position spaced from said fixed die, said dies cooperating to form a blank into a desired workpiece as said movable die moves to said forward position, control means operating to move said movable die toward said fixed die to a gripping position for gripping a blank independent of movement of said slide and thereafter allowing said slide to move said movable die to said forward position, said slide operating to move said movable die to said forward position from said gripping position and causing working of said blank to said desired workpiece, and transfer means timed with the operation of said control means operating to position a blank for gripping while said movable die moves to said gripping position and retracting from said dies to allow said slide to move said movable die from said gripping position to said forward position.

18. A header comprised in a frame, a stationary die on said frame, a movable die movable toward and away from said stationary die between an extended position adjacent said stationary die in a retracted position spaced from said stationary die, crank and pitman power means operating through repeated 360° cycle of operation in which said movable die is moved during the first portion of said cycle from said extended position to said retracted position, is subsequently moved during a second portion of said cycle from said retracted position to an intermediate gripping position in which a blank is gripped between said dies, and during a third portion of said cycle from said gripping position back to said extended position during which a blank is formed to a desired shape, and a transfer means operating in timed relation to the operation of said movable die operable to extend and insert a blank between said dies for gripping thereby and thereafter to retract clear of said dies, said first portion of said cycle being completed during about the first 100° of said cycle, said second portion of said cycle being completed by about the first 200° of said cycle, and said thrid portion occuring about the last 45° of said cycle, said transfer retraction commencing at about the 190° point in said cycle.

19. A header as set forth in claim 18 wherein said retraction occurs during about 140° of said cycle.

20. A header as set forth in claim 19 wherein said extension of said transfer occurs during about 140° of said cycle.

21. A header as set forth in claim 18 wherein a reciprocating slide operates to move said movable die between said gripping position and said extended position, and the position of said movable die is independent of the position of said slide during the remaining portions of said cycle.

22. A header comprising a frame, a stationary die on said frame, a movable die support mounted on said frame, a movable die mounted in a first bearing on said movable die support for linear movement along a line of action toward and away from said stationary die, adjustment means for laterally adjusting and positioning said die support and in turn said movable die with respect to said stationary die, a slide reciprocable in said frame supported by a second bearing separate from said first bearing, said slide operating to cause movement of said movable die toward said stationary die for forming a blank during a portion of the movement of said slide, control means for controlling the position of said movable die independent of the position of said slide during the remaining portions of the cycle of said machine, and transfer means operable to transfer blanks to a position for gripping by said dies.

* * * * *